US005606639A

United States Patent [19]

Lehoe et al.

[11] Patent Number: 5,606,639

[45] Date of Patent: Feb. 25, 1997

[54] STATIONARY CERAMIC GLASS ELECTRIC BASEBOARD HEATER

[76] Inventors: Michael C. Lehoe, P.O. Box 5781, Hauppauge, N.Y. 11788; James S. Lehoe, P.O. Box 314, Nesconset, N.Y. 11767; James A. Lehoe, P.O. Box 41, Cabot, Vt. 05647

[21] Appl. No.: 370,690

[22] Filed: Jan. 10, 1995

[51] Int. Cl.[6] ..... F24D 19/04

[52] U.S. Cl. ..... 392/353; 392/354; 392/344; 219/540; 219/544; 165/55

[58] Field of Search ..... 392/353, 352, 392/354, 344, 346; 219/530, 540, 544; 165/55; 29/611

[56] References Cited

U.S. PATENT DOCUMENTS

| | | | |
|---|---|---|---|
| 2,904,666 | 9/1959 | Jackson | 392/352 |
| 3,293,409 | 12/1966 | Snelling | 392/352 |
| 3,356,829 | 12/1967 | Brandenburg | 392/354 |
| 3,691,345 | 9/1972 | Needham et al. | 165/55 |
| 4,311,898 | 1/1982 | McMillan | 392/352 |

FOREIGN PATENT DOCUMENTS

| | | | |
|---|---|---|---|
| 592683 | 2/1960 | Canada | 392/352 |

*Primary Examiner*—John A. Jeffery
*Attorney, Agent, or Firm*—Galgano & Burke

[57] ABSTRACT

An electric baseboard heater includes a ceramic glass block within which a steel wire electric heating element is insert molded and which is provided with several through holes for convective movement of air through the block. The ceramic glass block is mounted in a heater housing which includes a lower draft opening below the ceramic glass block and an upper air outlet above the ceramic glass block. The glass block is preferably mounted so that one of its faces is exposed by the housing. When a voltage is applied to the steel wire, heat is generated by the wire and is absorbed and radiated by the ceramic glass block. Cool air is drawn into the draft opening in the housing and up through the through holes in the ceramic glass block whereupon it exits the air outlet heated by the ceramic glass block. The ceramic glass block is advantageously mounted at an angle in the housing to provide an aesthetically pleasing appearance while at the same time increasing the convective movement of air through the heater. The housing may be made of plastic or thin metal with a plastic film or enamel coating. The ceramic glass block may be clear so that the heating element can be seen to glow red when the heater is turned on. Alternatively, the ceramic glass block may be tinted or colored.

14 Claims, 3 Drawing Sheets

STATIONARY CERAMIC GLASS ELECTRIC BASEBOARD HEATER

BACKGROUND OF THE INVENTION

1. Field of the Invention

The invention relates to baseboard heaters. More particularly, the invention relates to a compact electric baseboard heater which is highly efficient and aesthetically appealing.

2. State of the Art

Baseboard heaters are well known in the art and typically include a relatively long metal housing having a height comparable to that of a baseboard. The housing is provided with a lower opening for receiving cool air and an upper opening for delivery of heated air. A heating element is placed inside the housing and air is heated by convection through the housing where heat is exchanged from the heating element to the air. The heating element may be a conduit carrying heated fluid or an electrical heating element. In the case of conduits carrying heated fluid, heat radiating fins may be attached to the conduit to aid in heat transfer. In the case of electric element heating, reflecting surfaces may be provided adjacent to the heating element to aid in heat transfer from the heating element to the air.

Most baseboard heaters have the disadvantage that they are visually unappealing, a disadvantage that is only partially mitigated by their relative size and location. Electric baseboard heaters have the further disadvantage that they are notoriously inefficient and require high voltage (typically 220 volts) in a permanent installation. The inefficiency of the electric heaters is partially because, unlike the fluid conduit heaters, heat is only transferred to the air when energy is being consumed. That is, when the electricity is shut off, the electric heating elements cool quickly. The fluid in the conduits of heated fluid heaters remains warm for some time after the energy used to heat the fluid is removed. In addition to their relative inefficiency, electric heaters have the disadvantage of being potentially dangerous. Exposed electric heating elements can cause ambient materials to ignite. Effectively shielding the electric heating element is a challenge because by doing so, the efficiency of heat transfer is often reduced by the shielding. Nevertheless, electric baseboard heaters have remained popular because they are easy and inexpensive to install.

SUMMARY OF THE INVENTION

It is therefore an object of the invention to provide an electric baseboard heater which operates on approximately 110 volts or less.

It is also an object of the invention to provide an electric baseboard heater which is relatively small and unobtrusive.

It is another object of the invention to provide an electric baseboard heater which is light weight and has a housing which may be constructed of non-metallic materials.

It is still another object of the invention to provide an electric baseboard heater which is safe and highly efficient.

In accord with these objects which will be discussed in detail below, the electric baseboard heater of the present invention includes a ceramic glass block within which a steel wire electric heating element is insert molded and which is provided with several through holes for convective movement of air through the block. The ceramic glass block is mounted in a heater housing which may be made of plastic or thin metal which is coated with a plastic film or enamel. The housing includes a lower draft opening below the ceramic glass block and an upper air outlet above the ceramic glass block. The glass block is preferably mounted so that one of its faces is exposed by the housing. When a voltage is applied to the steel wire, heat is generated by the wire and is absorbed and radiated by the ceramic glass block. Cool air is drawn into the draft opening in the housing and up through the through holes in the ceramic glass block whereupon it exits the air outlet heated by the ceramic glass block. The heater according to the invention is efficient because the ceramic glass heats very quickly and continues to radiate heat for a period of time after the voltage is removed from the steel wire. It is safe because the hot electric heating element is contained within the ceramic glass where it cannot contact flammable items. The ceramic glass block is advantageously mounted at an angle in the housing to provide an aesthetically pleasing appearance while at the same time increasing the convective movement of air through the heater. Because the housing is protected from the heating element by the ceramic glass, the housing may be made of plastic or thin metal with a plastic film or enamel coating. The ceramic glass block may be clear so that the heating element can be seen to glow red when the heater is turned on. Alternatively, the ceramic glass block may be tinted or colored. Thus, the heater may be made more aesthetically appealing by providing various color schemes in the housing and in the ceramic glass block. The heater according to the invention is designed to be permanently installed and connected to existing wiring, but the principles disclosed herein may also be applied to a portable heater. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
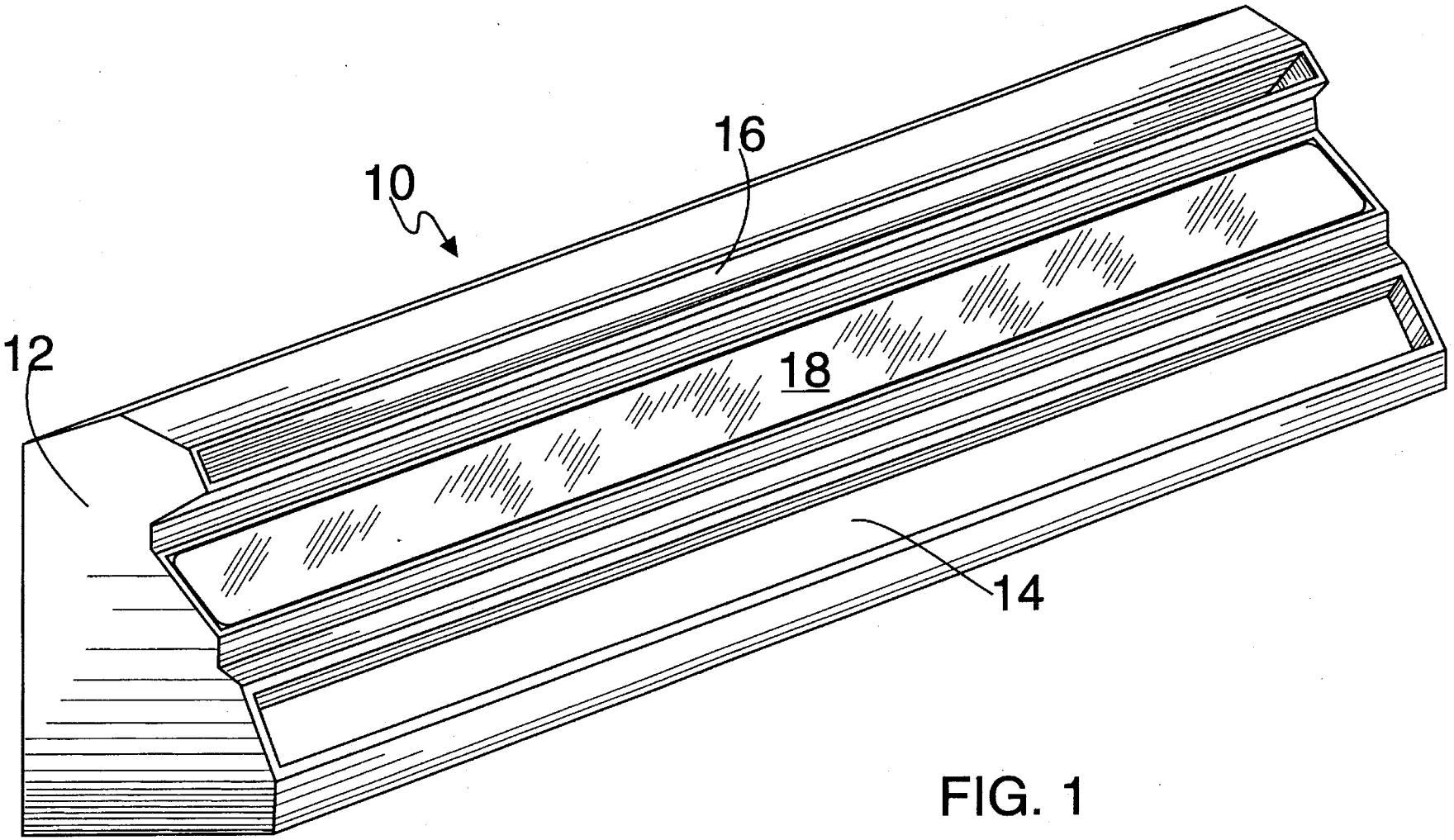
FIG. 1 is a perspective view of a ceramic glass electric baseboard heater according to the invention.
Figure 2:
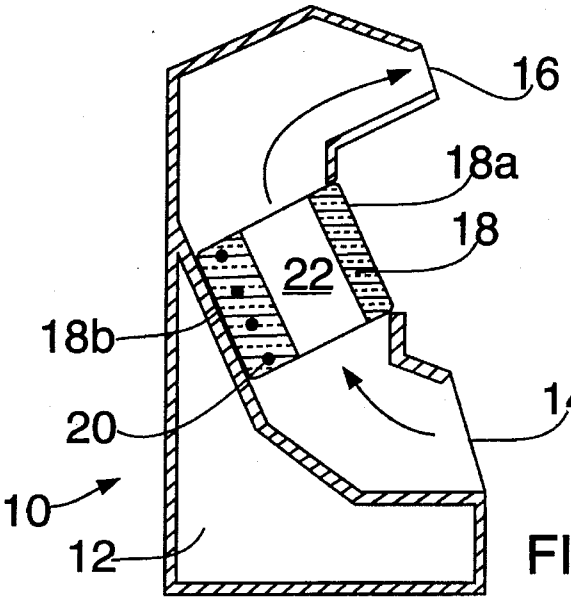
FIG. 2 is a sectional view of the heater of FIG. 1.

Referring now to FIGS. 1 and 2, the electric baseboard heater 10 according to the invention includes a housing 12 having an air inlet 14 and an air outlet 16. A heat tempered ceramic glass block 18 containing an insert molded electric heating element 20 is mounted in the housing 12 between the air inlet 14 and the air outlet 16. The glass block 18 is provided with at least one through hole 22 which is arranged relative to the air inlet 14 and the air outlet 16 such that air entering the air inlet is free to flow through the through hole 22 to the air outlet 16.

According to the presently preferred embodiment, the housing 12 has an overall height of approximately five inches, an overall depth of approximately two and a half inches, and is provided in lengths of from two to twelve feet. The air inlet 14 is preferably seven eighths of an inch high with a length which is slightly less than the length of the housing 12. The air outlet 16 is preferably five eighths of an inch high with a length which is slightly less than the length of the housing 12. The ceramic glass block 18 is preferably approximately one and three eighths inches high by one and three eighths inches deep and has a length which is slightly less than the length of the housing 12. As seen best in FIG. 2, the ceramic glass block 18 is preferably mounted in the housing 12 such that its at least one through hole 22 forms an angle with the vertical back of the housing of approximately 67°.

Figure 3:
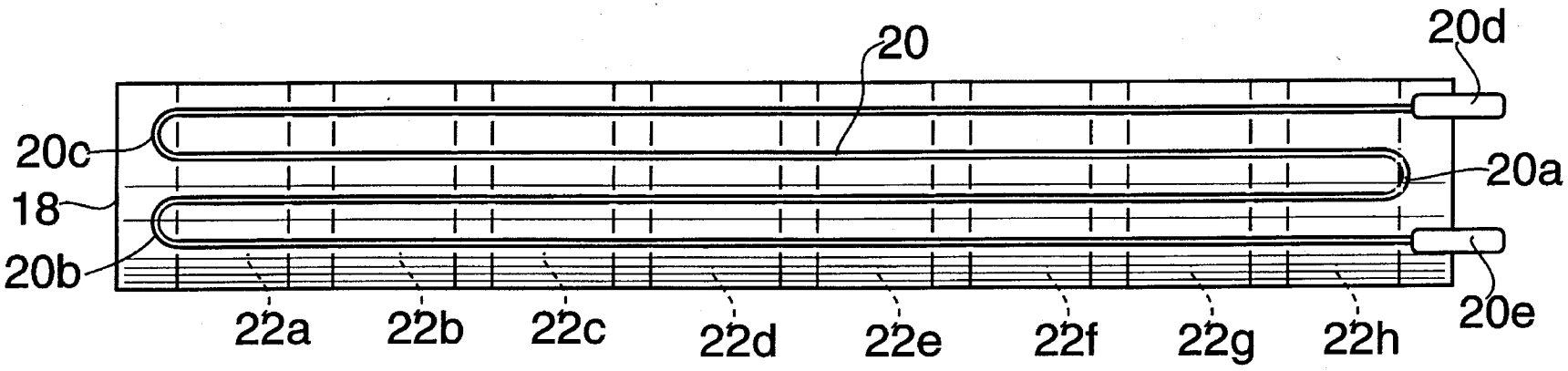
FIG. 3 is a rear view of the ceramic glass block of the heater of FIGS. 1 and 2.
Figure 4:
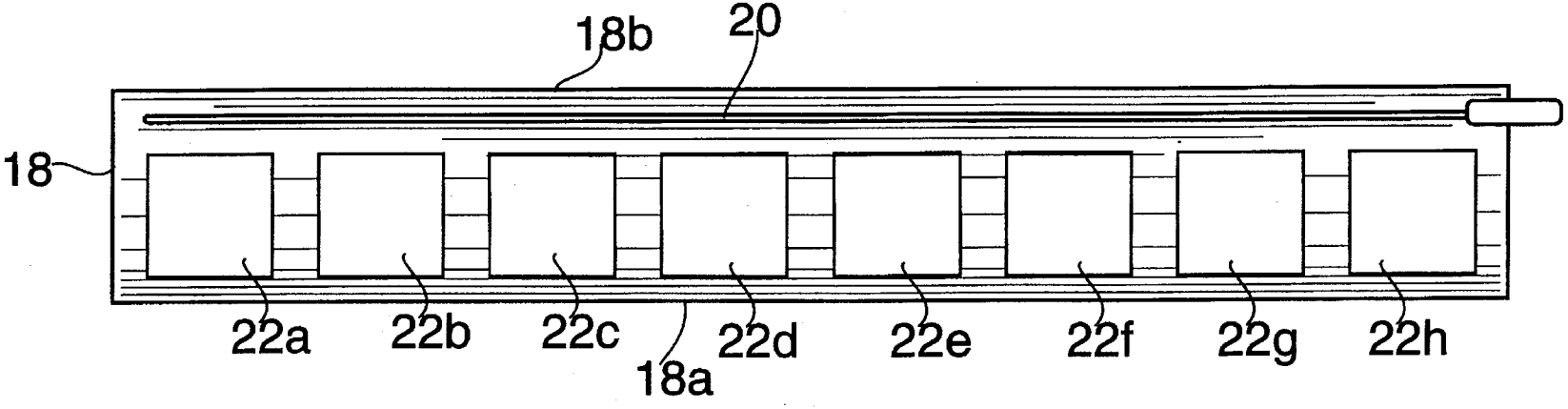
FIG. 4 is a bottom view of the ceramic glass block of FIG. 3.

Turning now to FIGS. 3 and 4, the ceramic glass block 18 is preferably provided with a number of evenly spaced through holes 22*a* through 22*h*. Each through hole is preferably three quarters of an inch square and is spaced approximately one quarter of an inch from the front face 18*a* of the glass block 18. The electric heating element 20 is preferably a single strand of steel wire having a diameter of approximately seven sixty-fourths of an inch. The wire 20 is insert molded in the glass block between the through holes 22*a*–22*h* and the rear face 18*b* of the block. The wire 20 is preferably provided with at least three bends 20*a*–20*c* so that the wire traverses the block 18 at least four times as shown in FIG. 3. It is advantageous that both ends of the wire 20 exit the block on the same side and that they be provided with electrical connectors 20*d* and 20*e* which are also insert molded in the block 18.

Figure 5:
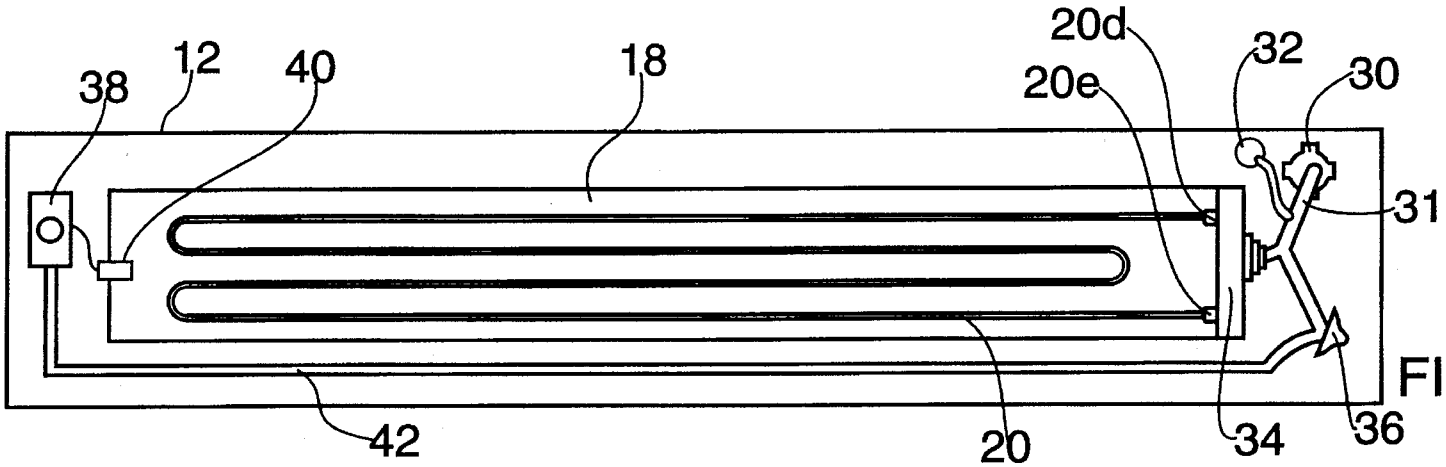
FIG. 5 is a schematic side elevation view of the location and wiring of the ceramic glass block in the heater according to the invention.

Turning now to FIG. 5, the housing 12 is preferably provided with an access hole 30 for cables 31 which are connected to standard 110 volt AC house mains and a grounding connection 32 so that the entire housing (if it is metallic) is grounded. An electrical connection block 34 is also provided in the housing for coupling with the electrical connectors 20*d* and 20*e* of the wire 20. An interior thermostat 38 is preferably coupled to a heat sensor 40 which is either attached to the ceramic glass block 18 or insert molded in it. The thermostat is coupled at 36 by interior wires 42 to the connection block 34 and automatically shuts the heater off if the glass block exceeds a predetermined maximum temperature. This is particularly useful in embodiments where the housing 12 is non-metallic.

Referring now to the Figures generally, and as mentioned above, the housing 12 may be enamel coated metal, in which case it may be one sixteenth inch thick metal with a one thirty-second inch thick coating. Alternatively, the housing may be made of heat resistant plastic or any other heat resistant material. The ceramic glass block may be clear, in which case, the glowing wire 20 is a visible indication that the heater is functioning. Alternatively, the glass block may be tinted or opaque and may be provided in various designer colors. Also, the overall shape of the heater 10 as seen best in FIGS. 1 and 2 provides an aesthetically pleasing and modern appearance while being relatively compact and unobtrusive. In addition, while the heater described herein is intended to be a stationary heater which is permanently attached to the baseboard, it is possible to adapt the features disclosed herein to a portable heater.

There have been described and illustrated a ceramic glass electric baseboard heater. While particular embodiments of the invention have been described, it is not intended that the invention be limited thereto, as it is intended that the invention be as broad in scope as the art will allow and that the specification be read likewise. Thus, while particular dimensions have been disclosed as preferred, it will be appreciated that other dimensions could be utilized. Also, while the housing has been shown with a particular shape, it will be recognized that other shapes could be used with similar results obtained. Moreover, while particular configurations have been disclosed in reference to number and locations of the through holes in the glass block, it will be appreciated that other configurations could be used as well. Furthermore, while the insert molded wire has been disclosed as having a certain number of turns and a certain location relative to the holes, it will be understood that different numbers of turns and a different location relative to the holes can achieve the same or similar function as disclosed herein. In addition, while the glass block has been shown mounted at an angle of sixty-seven degrees, it will be appreciated that other angles could be used without departing from the spirit of the invention. It will therefore be appreciated by those skilled in the art that yet other modifications could be made to the provided invention without deviating from its spirit and scope as so claimed.

What is claimed is:

1. An electric baseboard heater comprising:

a) a housing having a lower air inlet and an upper air outlet;

b) a ceramic glass block mounted in said housing between said lower air inlet and said upper air outlet, said ceramic glass block having at least one through hole for allowing air entering said lower air inlet to pass through said ceramic glass block and out of said upper air outlet;

c) an electric heating element insert molded in said ceramic glass block.

2. An electric baseboard heater according to claim 1, wherein:

said at least one through hole is disposed at an angle of approximately 67° relative to a vertical back portion of said housing.

3. An electric baseboard heater according to claim 1, wherein:

said electric heating element is a steel wire.

4. An electric baseboard heater according to claim 3, wherein:

said steel wire has at least three turns so that it traverses said ceramic glass block at least four times.

5. An electric baseboard heater according to claim 4, wherein:

said steel wire has two ends and both ends exit said ceramic glass block on the same side of said ceramic glass block.

6. An electric baseboard heater according to claim 5, wherein:

each end of said steel wire is provided with an electrical connector.

7. An electric baseboard heater according to claim 6, wherein:

each of said electrical connectors are insert molded in said ceramic glass block.

8. An electric baseboard heater according to claim 1, wherein:

said ceramic glass block has a front face and a rear face with said at least one through hole being located between said front face and said rear face.

9. An electric baseboard heater according to claim 8, wherein:

said ceramic glass block is mounted in said housing so that said front face is exposed.

10. An electric baseboard heater according to claim 8, wherein:

said electric heating element is located between said rear face and said at least one through hole.

11. An electric baseboard heater according to claim 1, wherein:

said at least one through hole comprises a plurality of through holes spaced along the length of said ceramic glass block.

12. An electric baseboard heater according to claim 11, wherein:

said plurality of through holes are arranged parallel to each other.

13. An electric baseboard heater according to claim 12, wherein:

said plurality of through holes each has a substantially square cross section.

14. An electric baseboard heater according to claim 1, further comprising:

d) a thermostat mounted on the interior of said housing; and e) a heat sensor attached to said ceramic glass block and electrically coupled to said thermostat.

* * * * *